US009695633B2

(12) United States Patent
Morris et al.

(10) Patent No.: US 9,695,633 B2
(45) Date of Patent: Jul. 4, 2017

(54) BRAKE DEVICE FOR CORDLESS LIFT SHADES

(71) Applicant: Springs Window Fashions, LLC, Middleton, WI (US)

(72) Inventors: John Morris, Middleton, WI (US); Dustin Johnson, Middleton, WI (US)

(73) Assignee: SPRINGS WINDOW FASHIONS, LLC, Middleton, WI (US)

( * ) Notice: Subject to any disclaimer, the term of this patent is extended or adjusted under 35 U.S.C. 154(b) by 0 days.

(21) Appl. No.: 15/013,495

(22) Filed: Feb. 2, 2016

(65) Prior Publication Data

US 2016/0222725 A1 Aug. 4, 2016

Related U.S. Application Data

(60) Provisional application No. 62/110,809, filed on Feb. 2, 2015.

(51) Int. Cl.
*E06B 9/322* (2006.01)
*E06B 9/262* (2006.01)

(52) U.S. Cl.
CPC ..... *E06B 9/322* (2013.01); *E06B 9/262* (2013.01); *E06B 2009/2627* (2013.01); *E06B 2009/3222* (2013.01); *E06B 2009/3225* (2013.01)

(58) Field of Classification Search
CPC .. E06B 9/322; E06B 9/324; E06B 2009/3222; E06B 9/262; E06B 2009/3225; E06B 2009/2627; B65H 75/4428
USPC ..... 160/178.2; 242/381.4
See application file for complete search history.

(56) References Cited

U.S. PATENT DOCUMENTS

| | | | | |
|---|---|---|---|---|
| 4,733,711 | A | 3/1988 | Schon | |
| 5,117,893 | A | 6/1992 | Morrison et al. | |
| 5,174,604 | A * | 12/1992 | Numazawa | B60R 22/42 242/381.4 |
| 5,328,113 | A | 7/1994 | de Chevron Villette et al. | |
| 5,341,864 | A | 8/1994 | Rupel et al. | |
| 5,357,712 | A | 10/1994 | Streeter | |
| 5,628,356 | A * | 5/1997 | Marocco | E06B 9/308 160/170 |
| 6,705,379 | B1 | 3/2004 | Nien | |
| 6,968,885 | B2 | 11/2005 | Nien | |
| 7,063,122 | B2 | 6/2006 | Colson et al. | |

(Continued)

FOREIGN PATENT DOCUMENTS

| | | |
|---|---|---|
| DE | 2012007010768 | 12/2007 |
| DE | 2012013000031 | 1/2013 |
| DE | 202014104193 | 9/2014 |

OTHER PUBLICATIONS

EP16153886.3 Extended European Search Report dated Jul. 7, 2016 (7 pages).

*Primary Examiner* — Blair M Johnson
(74) *Attorney, Agent, or Firm* — Michael Best & Friedrich LLP

(57) ABSTRACT

A covering for an architectural opening including a first rail, a second rail moveable relative to the first rail, and a lift assembly coupled to the first rail. The lift assembly includes a drum rotatable about an axis, and a brake selectively engageable with the drum. The brake automatically engages the drum to resist the second rail moving away from the first rail; and the brake automatically disengages the drum in response to the second rail moving toward the first rail.

20 Claims, 10 Drawing Sheets

(56) References Cited

U.S. PATENT DOCUMENTS

| | | | | |
|---|---|---|---|---|
| 7,143,802 | B2 | 12/2006 | Strand et al. | |
| 7,464,742 | B2 | 12/2008 | Oskam et al. | |
| 7,624,785 | B2 | 12/2009 | Yu et al. | |
| 7,740,045 | B2 | 6/2010 | Anderson et al. | |
| 8,118,077 | B2 | 2/2012 | Pflieger | |
| 8,230,896 | B2 | 7/2012 | Anderson et al. | |
| 8,347,937 | B2 | 1/2013 | Murphy | |
| 8,511,364 | B2 * | 8/2013 | Anderson | E06B 9/262 160/84.05 |
| 8,522,852 | B2 | 9/2013 | Yu et al. | |
| 8,573,281 | B2 | 11/2013 | Drew et al. | |
| 8,763,673 | B2 | 7/2014 | Jelic et al. | |
| 8,905,114 | B1 | 12/2014 | Whitaker | |
| 2006/0278348 | A1 * | 12/2006 | Huang | E06B 9/322 160/170 |
| 2011/0120823 | A1 | 5/2011 | Hansen et al. | |
| 2012/0234502 | A1 | 9/2012 | Chen | |
| 2012/0267060 | A1 | 10/2012 | Anderson et al. | |
| 2013/0087296 | A1 | 4/2013 | Mullet et al. | |
| 2013/0233499 | A1 | 9/2013 | Wu | |
| 2014/0014279 | A1 | 1/2014 | Defenbaugh et al. | |
| 2014/0076504 | A1 | 3/2014 | Anthony et al. | |
| 2015/0136336 | A1 * | 5/2015 | Huang | E06B 9/322 160/170 |
| 2016/0138331 | A1 * | 5/2016 | Huang | E06B 9/322 160/189 |
| 2016/0222721 | A1 * | 8/2016 | Rettig | E06B 9/266 |
| 2016/0222723 | A1 * | 8/2016 | Morris | E06B 9/262 |
| 2016/0222724 | A1 * | 8/2016 | Morris | E06B 9/322 |
| 2016/0222725 | A1 * | 8/2016 | Morris | E06B 9/262 |

* cited by examiner

BRAKE DEVICE FOR CORDLESS LIFT SHADES

CROSS-REFERENCE TO RELATED APPLICATIONS

This application claims priority to U.S. Provisional Patent Application No. 62/110,809, filed on Feb. 2, 2015, and entitled "Brake Device for Cordless Lift Shades," the contents of which is hereby incorporated by reference in its entirety.

FIELD OF INVENTION

The present invention relates to architectural coverings, and more specifically to cordless window shades.

BACKGROUND

It should be appreciated that a "cordless" shade generally refers to a shade that is positioned (or repositioned) by manually adjusting one or more rails, instead of adjusting rail position by a drawstring (or a draw cord). A "cordless" shade does not require that all cords associated with the shade be eliminated, as a "cordless" shade can include, for example, lift cords that extend between rails.

Cordless shades known as "sun-up, sun-down" shades include two shade material panels and "bottom-up, top-down" shades include a single shade material panel that may be lowered from both the bottom and top. Both of the "sun-up, sun-down" and "bottom-up, top-down" shades include an intermediate rail between a head rail and a bottom rail.

SUMMARY

The invention provides, in one aspect, a covering for an architectural opening including a first rail, a second rail moveable relative to the first rail, and a lift assembly coupled to the first rail. The lift assembly includes a drum rotatable about an axis, and a brake selectively engageable with the drum. The brake automatically engages the drum to resist the second rail moving away from the first rail; and the brake automatically disengages the drum in response to the second rail moving toward the first rail.

The invention provides, in yet another aspect, a cradle assembly for an architectural opening covering. The cradle assembly includes a cradle, a drum supported within the cradle and rotatable about an axis, a cord coupled to the first drum, and a cover pivotally coupled to the cradle. The cord biases the cover to pivot toward the drum and apply a braking force that inhibits rotation of the drum.

The invention provides, in yet another aspect, a covering for an architectural opening including a head rail, a bottom rail moveable relative to the head rail, and a lift assembly coupled to the head rail. The lift assembly includes a spring motor, a drive shaft coupled to the spring motor and defining a rotational axis, a cradle rotatably supporting a drum about the rotational axis, a cord coupled between the drum and the bottom rail, and a cover pivotally coupled to the cradle. In response to the bottom rail moving away from the head rail, the cord biases the cover to pivot toward the drum and apply a braking force that inhibits rotation of the drum. In response to the bottom rail moving toward the first rail the braking force is removed.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
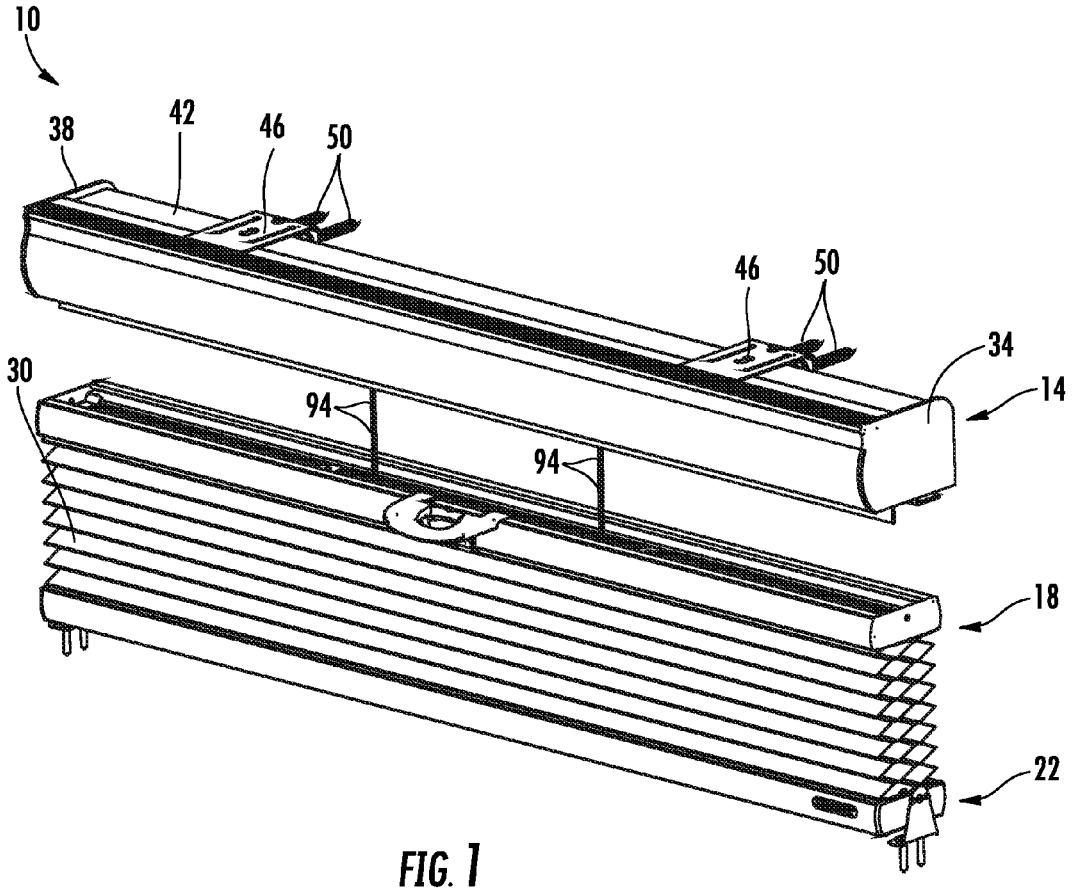
FIG. 1 is a front perspective view of a window covering in accordance with an embodiment of the invention.
Figure 2:
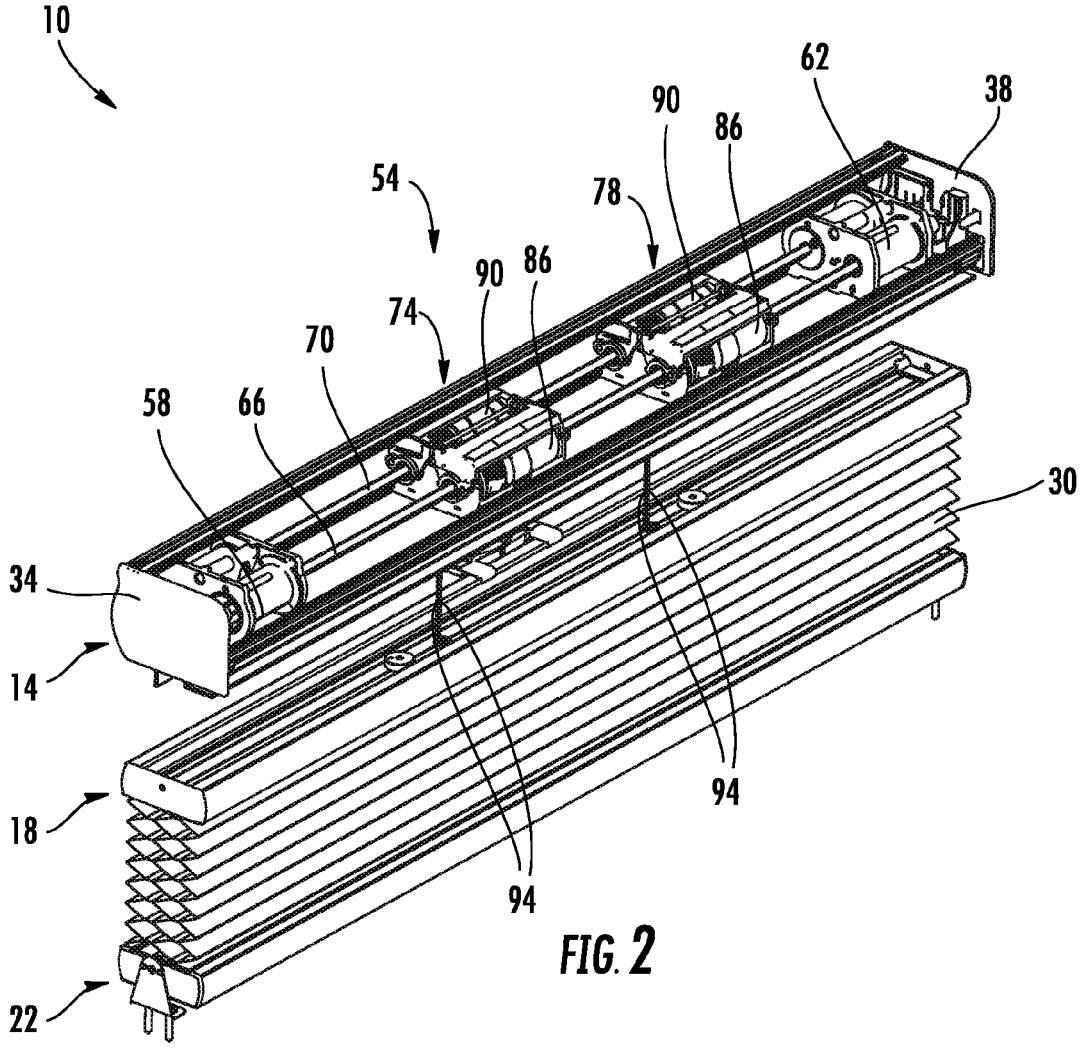
FIG. 2 is a rear perspective view of the window covering of FIG. 1 with portions removed to clearly show a lift assembly including two cradle assemblies.

With reference to FIGS. 1-2, a covering 10 for an architectural opening (e.g., a window, etc.) is illustrated with a head rail 14, an intermediate rail 18, and a bottom rail 22. The window covering 10 further includes a lower window covering panel 30 extending between the intermediate rail 18 and the bottom rail 22, and no material extending between the head rail 14 and the intermediate rail 18 (a.k.a. a "bottom-up, top-down" cordless shade). The intermediate rail 18 is moveable with respect to the head rail 14, and the bottom rail 22 is moveable with respect to the intermediate rail 18 and the head rail 14. The head rail 14 includes a first end cap 34 and a second end cap 38 positioned at opposite ends of the head rail 14, and a dust cover 42. A plurality of mounting brackets 46 are provided for attaching the multi-panel window covering 10 to, for example, a wall adjacent a window, a ceiling above a window, or at various positions on the window itself. In the illustrated embodiment, the brackets 46 are configured to receive a plurality of fasteners 50 for anchoring the brackets 46 to the wall, ceiling, or window structure.

With continued reference to FIG. 1, the lower window covering panel 30 is positioned beneath the open space between the intermediate rail 18 and the head rail 14. The window covering panel 30 may have different characteristics, including but limited to: light blocking ability, color, structure, or aesthetic appearance. For example, a window covering panels can be relatively sheer for allowing significant light to pass there through while obscuring vision through the window, and the other panel can be opaque so as to provide room darkening. In the illustrated embodiment, the lower window covering panel 30 are cellular fabrics. More specifically, the panel 30 is illustrated as double-cell cellular fabrics but any number of cells (i.e., single or multi-cell) fabrics may be used. In alternative embodiments, the upper and lower window covering panels are pleated fabrics. Additionally or alternatively, any combination of pleated, cellular fabrics, or other types of window covering material (e.g., Venetian blinds) can be used. In further alternative embodiments, an upper window covering panel is added between the intermediate rail 18 and the head rail 14 (a.k.a. a "sun-up, sun-down" cordless shade). Also, in alternative embodiments, the window covering is a single panel window covering (i.e., including only a head rail and a bottom rail).

With reference to FIG. 2, a lift assembly 54 for the window covering 10 is positioned within a substantially enclosed space that is at least partially defined by the dust cover 42 and the end caps 34, 38 of the head rail 14. The dust cover 42 and other portions have been removed in FIG. 2 for clarity purposes. The lift assembly 54 is coupled to the head rail 14 and includes a first spring motor 58, a second spring motor 62, a first drive shaft 66 (i.e., a drive rod), a second drive shaft 70, a first cradle assembly 74, and a second cradle assembly 78. U.S. Pat. No. 7,143,802 provides additional disclosure regarding the components contained in the first and second spring motor 58, 62, and is incorporated herein by reference in its entirety. In the illustrated embodiment, the first spring motor 58 is drivingly coupled to the first drive shaft 66 and the second spring motor 62 is drivingly coupled to the second drive shaft 70. The first cradle assembly 74 and the second cradle assembly 78 are both coupled to each of the first and second drive shafts 70, 74. As explained in greater detail below, the first and second spring motors 58, 62 are provided for assisting a user with lifting the intermediate and bottom rails 18, 22 (including the lower window covering panel 30) between the fully extended and fully retracted positions.

With continued reference to FIG. 2, each of the first and second cradle assemblies 74, 78 includes a first winding drum 86 and a second winding drum 90. Lift cords 94 are partially wound around the winding drums 86, 90 and extend from the winding drums 86, 90 to the intermediate rail 18 and the bottom rail 22. The first spring motor 58 is connected to the drive shaft 66, and the drive shaft 66 is connected to the winding drum 86 for winding on and winding off the lift cord 94 connected between the head rail 14 and the bottom rail 22. Likewise, the second spring motor 62 is connected to the drive shaft 70, and the drive shaft 70 is connected to the winding drum 90 for winding on and winding off the lift cord 94 connected between the head rail 14 and the intermediate rail 18. More specifically, the drive shafts 66, 70 are received within a square-shaped aperture 98 formed within the first and second drums 86, 90. In the illustrated embodiment, two lift cords 94 are provided between the head rail 14 and the bottom rail 22, and two other lift cords 94 are provided between the head rail 14 and the intermediate rail 18. One winding drum 86, 90 is provided for each lift cord 94 used in the window covering 10. Accordingly, in the illustrated embodiment, four winding drums 86, 90 are provided for the four lift cords 94 shown with two winding drums 86 for the two lift cords 94 extending between the head rail 14 and the bottom rail 22, and two winding drums 90 for the two lift cords 94 extending between the head rail 14 and the intermediate rail 18. In the illustrated embodiment, each cradle assembly 74, 78 includes two lift cords 94 with one lift cord 94 extending between the head rail 14 and the bottom rail 22 and the other lift cord 94 extending between the head rail 14 and the intermediate rail 18.

In other words, the first spring motor 58 is provided for working together with lift cords 94 connected between the head rail 14 and the bottom rail 22, and the second spring motor 62 is provided for working together with the lift cords 94 connected between the head rail 14 and the intermediate rail 18. The spring motors 58, 62 include a spring therein to store energy as the window covering is extended so that the stored energy can be utilized to assist lifting the window covering material from a more extended position to a more retracted position.

The lift cords 94 extend through internal holes or openings of the window covering panel 30 so as not to be visible in the cellular panels and only minimally visible through the pleated panels. As the window covering panel 30 is extended or retracted, the lift cords move relative to the panels 30 so that the panel 30 is compressed or extended. Two of the lift cords 94 extend only to the intermediate rail 18. Accordingly, extending or retracting the unwound the length of these two lift cords 94 adjusts the position of the intermediate rail 18 relative to the head rail 14 and thereby the amount of exposure of the opening between the head rail 14 and the intermediate rail 18. The other two lift cords 94 extend through the intermediate rail 18, through the lower window covering panel 30 and are attached to the bottom rail 22. Accordingly, extending or retracting the unwound length of these two later described lift cords 94 adjust the position of the bottom rail 22 relative to the head rail 14 and, together with the positioning of the intermediate rail 18 relative to the head rail 14 one determines the amount of exposure of the lower window covering panel 30 between the intermediate rail 18 and the bottom rail 22.

With continued reference to FIG. 2, the winding drums 86, 90 for each pair of lift cords 94 are provided in front to back relationships immediately above the lift cord paths through the material panel 30. Accordingly, in each pair of lift cords 94, one lift cord engages the forward winding drum 90 and the other lift cord engages the rearward winding drum 86. The forward winding drums 90 are engaged on the same drive shaft 70 and are thereby connected to the same spring motor assembly 62. The rearward winding drums 90 are engaged on the other drive shaft 66 and are thereby connected to the other spring motor assembly 58. The two lift cords 94 connected to the bottom rail 22 are engaged with the rearward winding drums 86 and the two lift cords 94 connected to the intermediate rail 18 are engaged with the forward winding drums 90. Accordingly, both lift cords 94 connected to the bottom rail 22 are operated by the same spring motor assembly 58 and both lift cords 94 connected to the intermediate rail 18 are operated by the other spring motor assembly 62.

Figure 3:
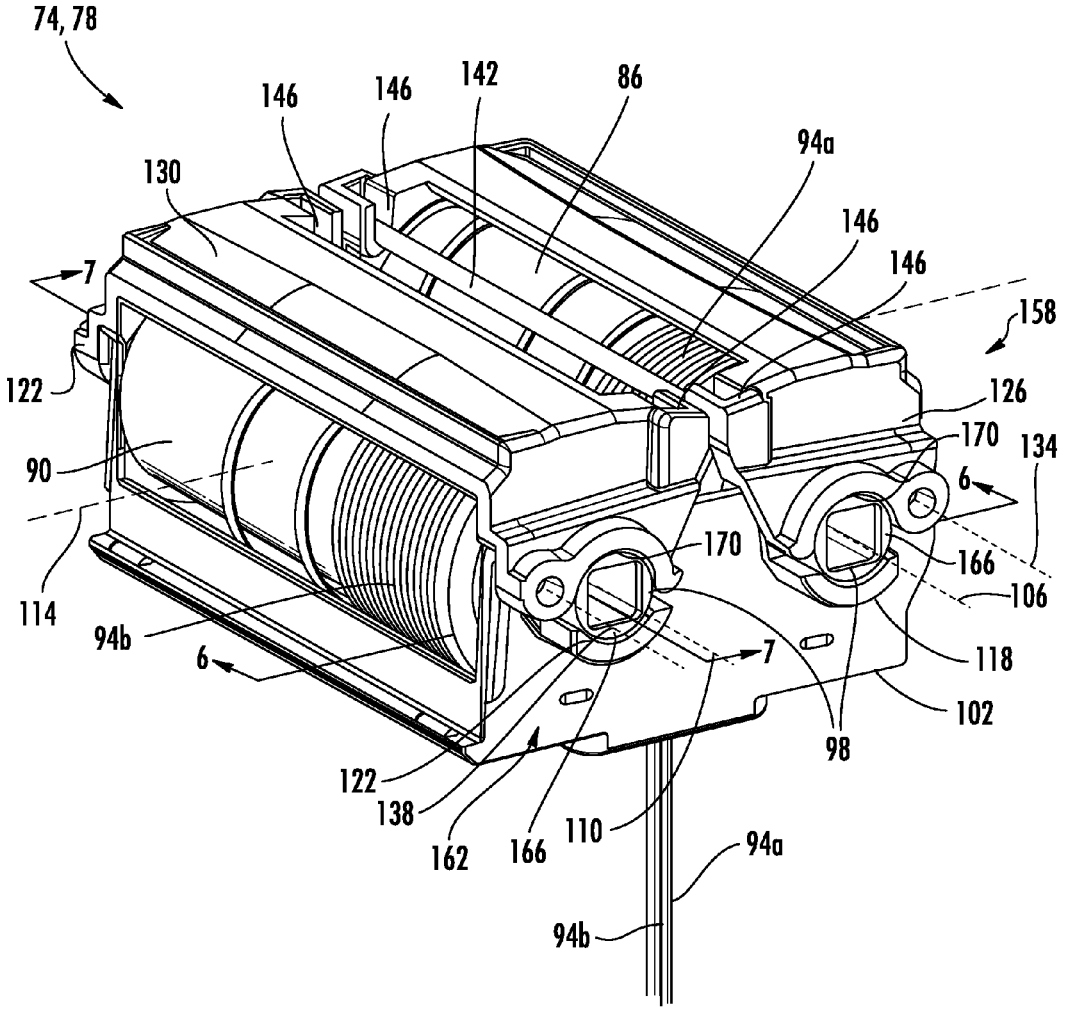
FIG. 3 is a perspective view of one of the cradle assemblies of FIG. 2.

With reference to FIGS. 3-6, the first cradle assembly 74 is illustrated in greater detail. In the illustrated embodiment, the first cradle assembly 74 is identical to the second cradle assembly 78. As illustrated in FIG. 3, the cradle assembly 74 includes a cradle 102 and the first winding drum 86 is supported within the cradle 102 for rotation about a first axis 106. The second winding drum 90 is also supported within the cradle 102 for rotation about a second axis 110. The first axis 106 is parallel to and offset from (i.e., non-coaxial with) the second axis 110. A first lift cord 94*a* is coupled between the first drum 86 and the bottom rail 22 (shown in FIGS. 1-2) and a second lift cord 94*b* is coupled between the second drum 90 and the intermediate rail 18 (also shown in FIGS. 1-2). The first drum 86 is offset from the second drum 90, and at least a portion of the first drum 86 overlaps a portion of the second drum 90 along a third axis 114 that is perpendicular to the first axis 106 and the second axis 110. In other words, the first drum 86 and the second drum 90 overlap in at least one axial location along the head rail 14. In the illustrated embodiment, the first drum 86 overlaps entirely with the second drum 90 along the third axis 114. In other words, the first and second drums 86, 90 are positioned in a side-by-side arrangement within a single, common cradle 102.

Figure 4:
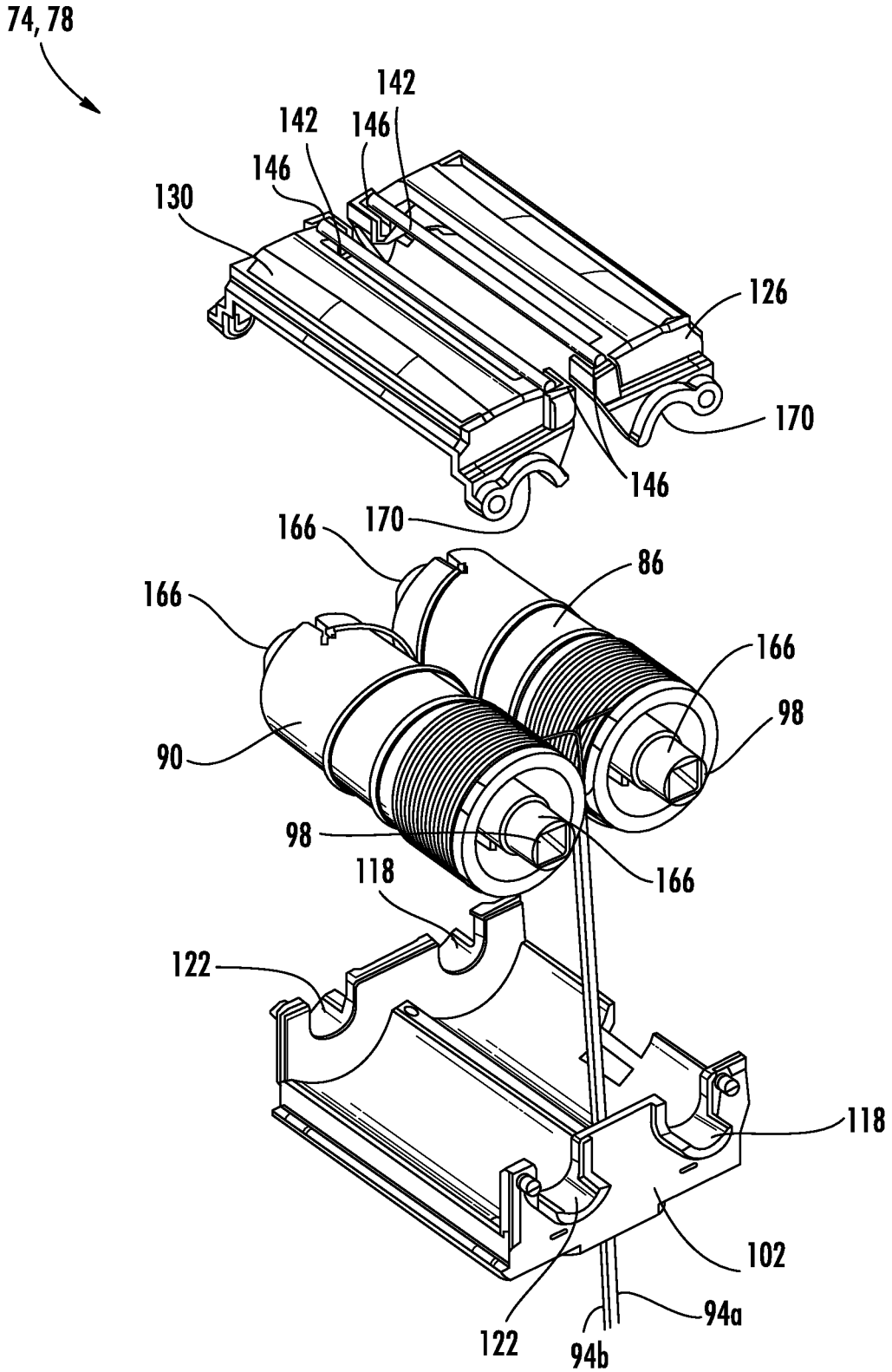
FIG. 4 is an exploded view of the cradle assembly of FIG. 3.

With reference to FIGS. 3 and 4, the cradle 102 includes a pair of first supports 118 extending along the first axis 106 upon which the first drum 86 is rotatably supported. The cradle 102 also includes a pair of second supports 122 extending along the second axis 110 upon which the second drum 90 is rotatably supported. In the illustrated embodiment, the first spring motor 58 is drivingly coupled to the first drive shaft 66 (see FIG. 2), which is coupled to the first drum 86 for co-rotation therewith. Similarly, the second spring motor 62 is drivingly coupled to the second drive shaft 70 (see FIG. 2), which is coupled to the second drum 90 for co-rotation therewith. In the illustrated embodiment, the first drive shaft 66 also defines the first rotational axis 106 of the first drum 86 and the second drive shaft 70 also defines the second rotational axis 110 of the second drum 90.

Figure 6:
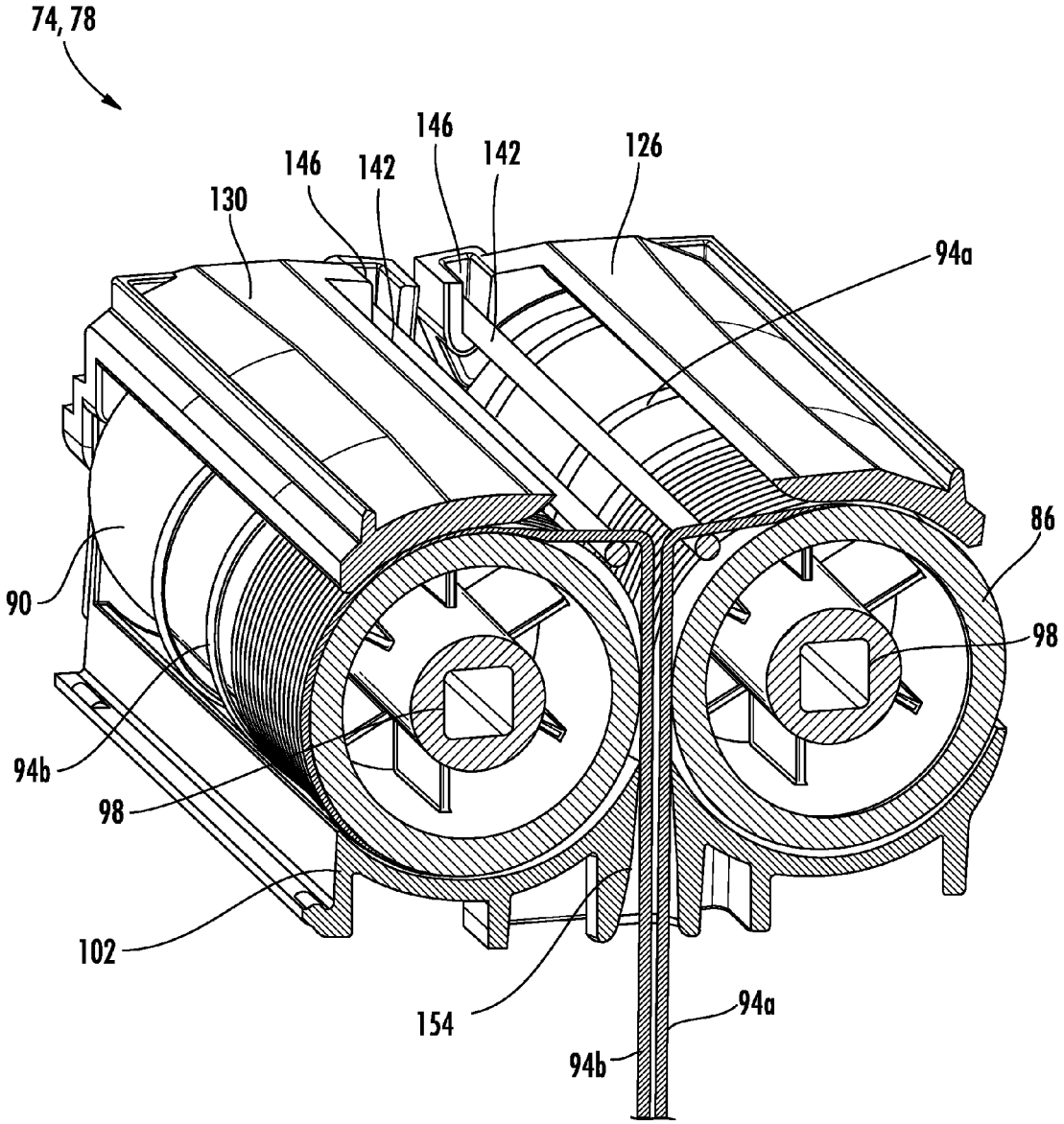
FIG. 6 is a cross-sectional view of the cradle assembly of FIG. 3 taken along lines 6-6 shown in FIG. 3.

With continued reference to FIG. 4, the cradle assembly 74 further includes a first cover 126 pivotally attached to the cradle 102 above the first drum 86 and a second cover 130 pivotally attached to the cradle 102 above the second drum 90. Specifically, the first cover 126 is pivotable about a first pivot axis 134 and the second cover 130 is pivotable about a second pivot axis 138. Each of the first cover 126 and the second cover 130 include a wear bar 142 received within notches 146 formed on the covers 126, 130. The first lift cord 94*a* is supported upon the wear bar 142 of the first cover 126 and the second lift cord 94*a* is supported upon the wear bar 142 of the second cover 130 (FIG. 6). In other words, the lift cords 94*a*, 94*b* are threaded from the winding drums 86, 90 over the wear bars 142. The lift cords 94*a*, 94*b* bias the wear bar 142 and cause the covers 126, 130 to pivot into engagement with a portion of the drums 86, 90, respectively. This results in a braking force between the winding drum 86, 90 and the pivoting cover 126, 130 to resist the rotation of the winding drum 86, 90, as described below in more detail.

With reference to FIG. 3, the cradle assembly 74 includes a plurality of brakes 158, 162 that are selectively engageable with the drums 86, 90. The brakes 158, 162 are formed by the pivoting covers 126, 130 and the underlying supports 118, 122 upon which the drums 86, 90 rotate. For example, the pivoting cover 126 is pivotally coupled to the cradle 102 and the cover 126 at least partially surrounds a hub 166 of the drum 86. More specifically, the pivoting cover 126 in the illustrated embodiment includes a clamping portion 170 that surrounds approximately the upper half of the hub 166. Likewise, the supports 118 extending from the cradle 102 are positioned underneath the hub 166 and surround approximately the lower half of the hub 166.

Figure 8A:
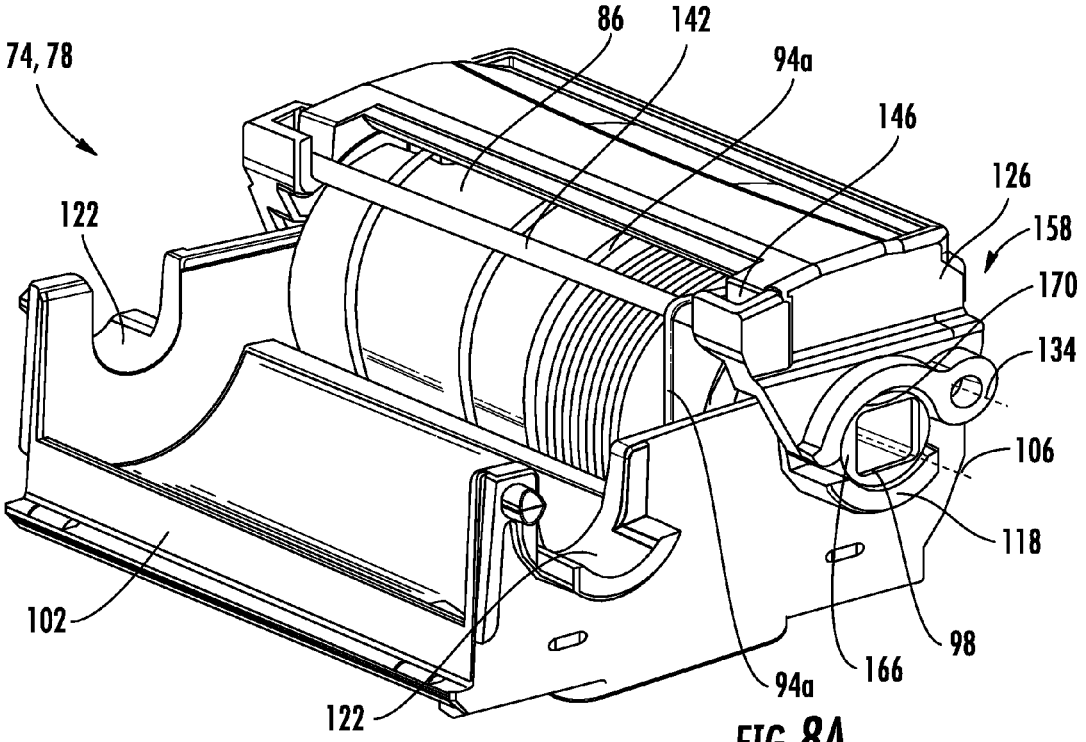
FIG. 8A is perspective view of the cradle of FIG. 3 with portions removed for clarity showing a cover.

With reference to FIG. 8A, the lift cord 94*a* is biasing the cover 126 to pivot toward the drum 86, causing the brake 158 (i.e., the clamping portion 170 of the cover 126 and the supports 118) to apply a braking force that opposes (i.e., inhibits) rotation of the drum 86. The lift cord 94*a* biases the cover 126 toward the drum 86 and apply a braking force that opposes rotation of the drum 86 in response to the cord 94*a* being unwound from the drum 86. In addition, the cord 94*a* also biases the cover 126 toward the drum 86 when the cord 94*a* is stationary (i.e., when the bottom rail 22 is stationary). In other words, in response to the bottom rail 22 moving away from the head rail 14, the brake 158 automatically engages the drum 86 to resist the bottom rail 22 from moving away from the head rail 14. More specifically, in response to the bottom rail 22 moving away from the head rail 14, the cord 94*a* presses down on the wear bar 142 and presses the cover 126 toward the supports 118 on the cradle 102 to press against the hub 166 of the drum 86. The cover 126 remains engaged with the hub 166 of the drum 86 when the bottom rail 22 is stationary with respect to the head rail 14. In the illustrated embodiment of FIG. 8A, the cover 126 always remains engaged with the hub 166, but the brake 158 applies a braking force only when the bottom rail 22 is moved away from the head rail 14 or the bottom rail 22 is stationary. In particular, when the lift cord 94*a* is being wound onto the drum 86, the lift cord 94*a* no longer biases the cover 126 toward the drum 86 as much as when the lift cord is being unwound. As such, the brake 158 automatically disengages the drum 86 (i.e., the braking force is removed) in response to the bottom rail 22 moving toward the head rail 14. In other words, in response to the bottom rail 22 moving toward the head rail 14, the cover 126 floats above the support 118 and disengages the hub 166 of the drum 86. When lifting the bottom rail 22, the cover panel 30 is also lifted or pushed upward so weight is lessened on the cords 94, causing pressure on the braking surfaces (i.e., the clamping portion 170 and supports 118, 122) is relaxed and the lift assembly 54 works freely to reel in the lift cords 94.

Figure 8B:
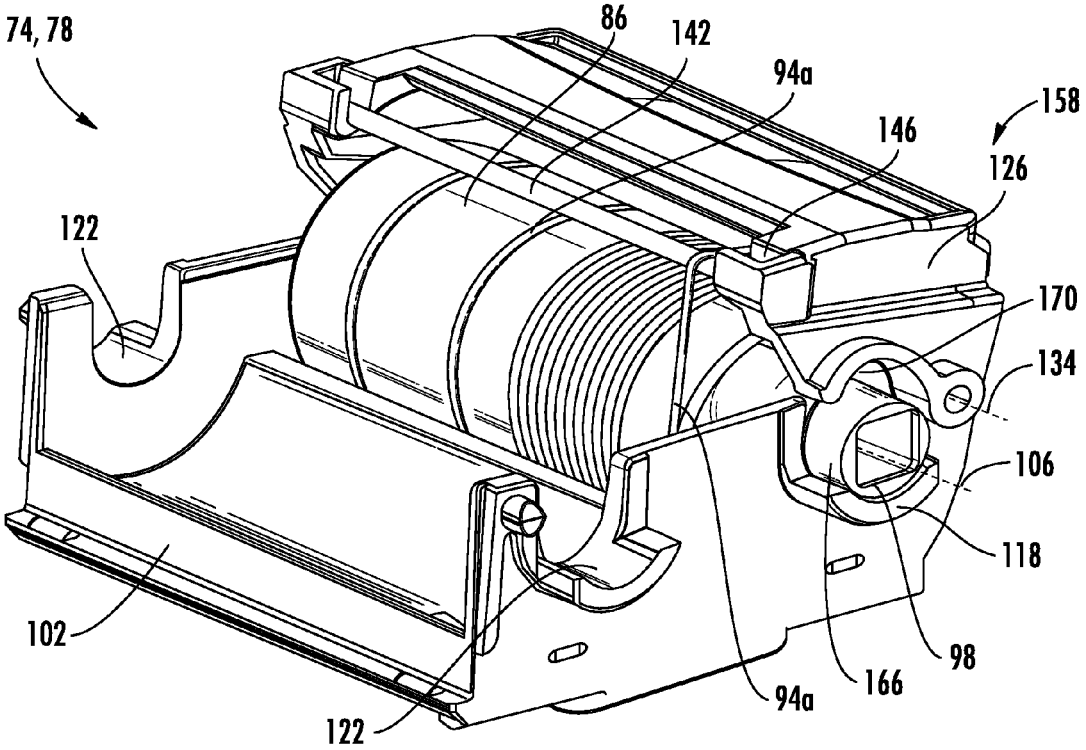
FIG. 8B is a perspective view of a cradle with portions removed for clarity, showing a cover according to an alternative embodiment.

With reference to FIG. 8B, an alternative brake 158 embodiment is illustrated with a cover 126 that is biased to pivot away from the drum 86 when the lift cord 94*a* being wound onto the drum 86. In this alternative embodiment, a spring or other suitable biasing mechanism lifts the cover 126 out of engagement with the hub when lifting the bottom rail 22. As such, the brake 158 automatically disengages the drum 86 (i.e., the braking force is removed) in response to the bottom rail 22 moving toward the head rail 14. In other words, in response to the bottom rail 22 moving toward the head rail 14, the cover 126 pivots away from the support 118 and disengages the hub 166 of the drum 86. When lifting the bottom rail 22, the cover panel 30 is also lifted or pushed upward so weight is lessened on the cords 94, causing pressure on the braking surfaces (i.e., the clamping portion 170 and supports 118, 122) is relaxed and the lift assembly 54 works freely to reel in the lift cords 94.

The positioning of the cover 126 in FIG. 8B has been exaggerated in order to emphasize and to clearly show the movement of the cover 126. However, in some embodiments, the cover 126 does not rotate as far away from the drum 86 as shown in FIG. 8B when the cord is being wound onto the drum 86. In other words, the pivoting cover 126 may be just slightly above the hub 166 to disengage the brake 158. In further alternative embodiments, the pivoting cover 126 may not pivot away from the hub 166 to create space but merely reduce the amount of clamping force between the clamping portion 170 and the support 118 acting on the drum 86 when the cord 94*a* is being wound onto the drum 86 (i.e., FIG. 8A).

In the illustrated embodiment, the brake 158 is identical to the brake 162, with the brake 158 resisting rotation of the drum 86 in one direction (i.e., an unwinding direction) and the brake 162 resisting rotation of the drum 90 in one direction (i.e., an unwinding direction). As such, the second brake 162 automatically engages the second drum 90 to resist the intermediate rail 18 moving away from the head rail 14. In addition, the second brake 162 automatically disengages the second drum 90 in response to the intermediate rail 18 moving toward the head rail 14.

In the illustrated embodiment, the pivoting cover 126 is configured to pivot away from the cradle 102 and the drum 86 in order to allow the drum 86 to be removed from the cradle 102 by a user. For example, the cover 126 can be pivoted clockwise from the reference of FIG. 8A by at least 90 degrees to open and permit a user access to the drum 86.

The automatic brakes 158, 162 engage and disengage automatically in the lift assembly 54 to help hold the shade at the desired height. The brakes 158, 162 use the hanging weight of the shade to apply braking action directly to the drums 86, 90, thereby holding the shade at the adjusted position. The brake action combines with the balance between the spring motors 58, 62 and the bottom rail 22 and the intermediate rail 18 weight to prevent the rails 18, 22 from raising and lowering. When the shade is hanging, or being lowered, the brakes 158, 162 are engaged. When the shade is being lifted, weight on the cords is reduced, thereby disengaging the brakes 158, 162. This allows the lift assembly 54 to reel in the cords 94 more rapidly and with less spring motor power required, which in turn maintains the fabric panel under tension so that the fabric does not balloon out as the shade is being lifted.

With the brakes 158, 162, lighter strength spring motors are required, which reduces the pull force needed to operate the shade. The requirement for multiple spring assist motors on larger shades can be reduced. Since the braking action helps hold the shade at a desired height, motor selection and bottom rail weight determinations are less critical. The positive braking action overcomes deficiencies that might otherwise result in either upward or downward creep of the fabric panel. The positive braking action can reduce the need for added weights in the bottom rail. Less weight in the bottom rail has several advantages, including reducing shipping costs and facilitating operation of the shade by making the bottom rail lighter.

In the illustrated embodiment, the braking surfaces (i.e., the clamping portions 170 and the supports 118, 122) are provided on the covers 126, 130 and the cradle 102 to clamp down on the hub 166 at both ends of the drums 86, 90. In alternative embodiments, the clamping force can be applied to just one end of the cord drums rather than at both ends. In further alternative embodiments, the braking surfaces can be provided on the cover and the cradle to clamp down on another surface of the cord drum, such as the main body of the drum. In further alternative embodiments, braking surfaces can be provided on just the cover to clamp down on the hub at one end of the cord drum, the hubs at both ends of the drum or, some other surface of the drum. A braking surface or braking surfaces can be provided to clamp down directly on a traversing shaft, such as drive shaft 66, or on an added surface attached to the drive shaft. Still further braking surfaces can be provided against the lift cord. Braking surfaces can be provided on the cover to clamp down on the winding shaft that connects the cord drums or a separate drum or surface attached to the shaft positioned next to the cradle. In short, a separate brake can be provided including its own brake drum and brake shoes operated by the weight of the shade itself suspended from the lift cords.

Figure 5:
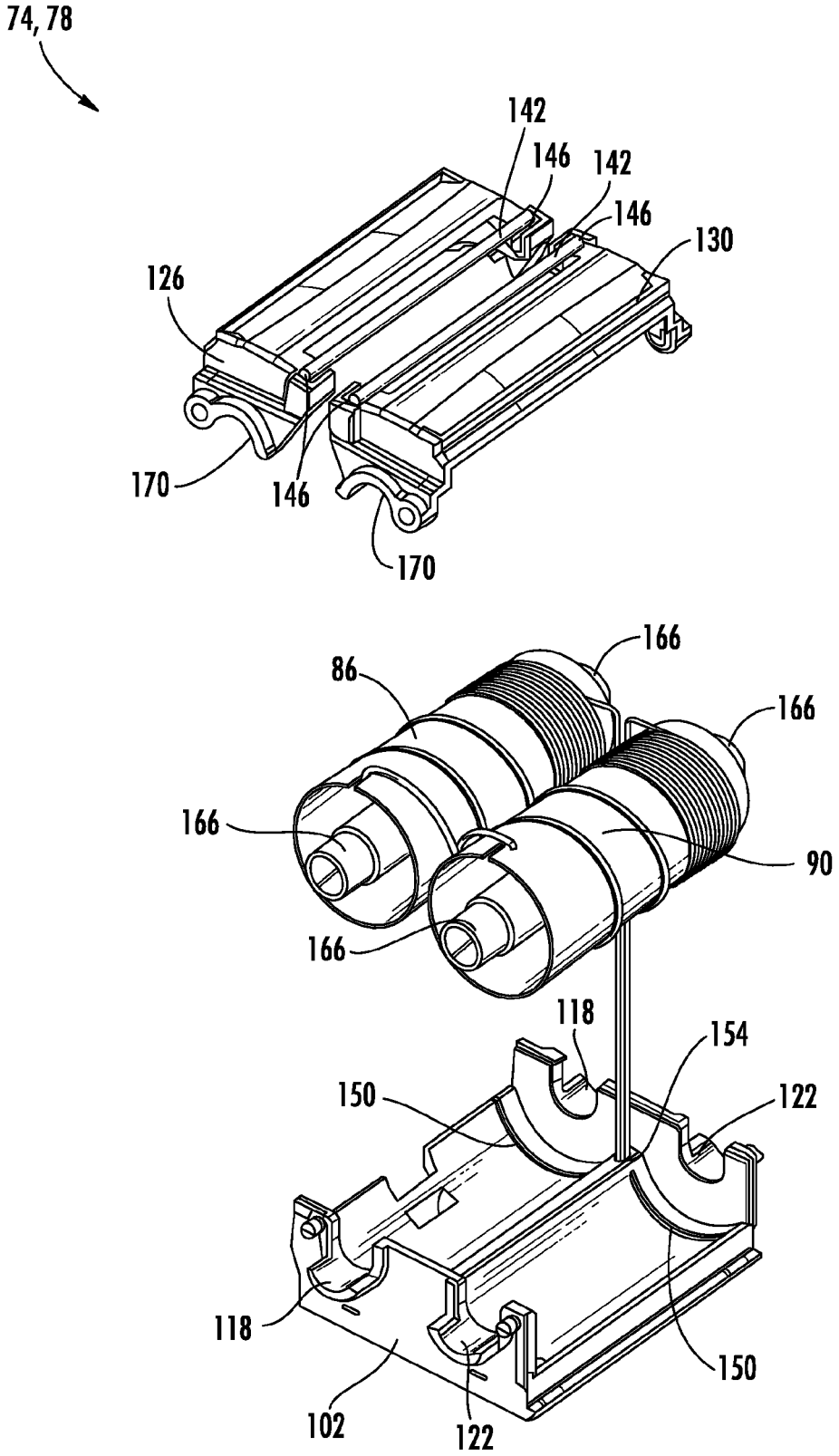
FIG. 5 is another exploded view of the cradle assembly of FIG. 3, viewed from an opposite side as the view in FIG. 4.
Figure 7:
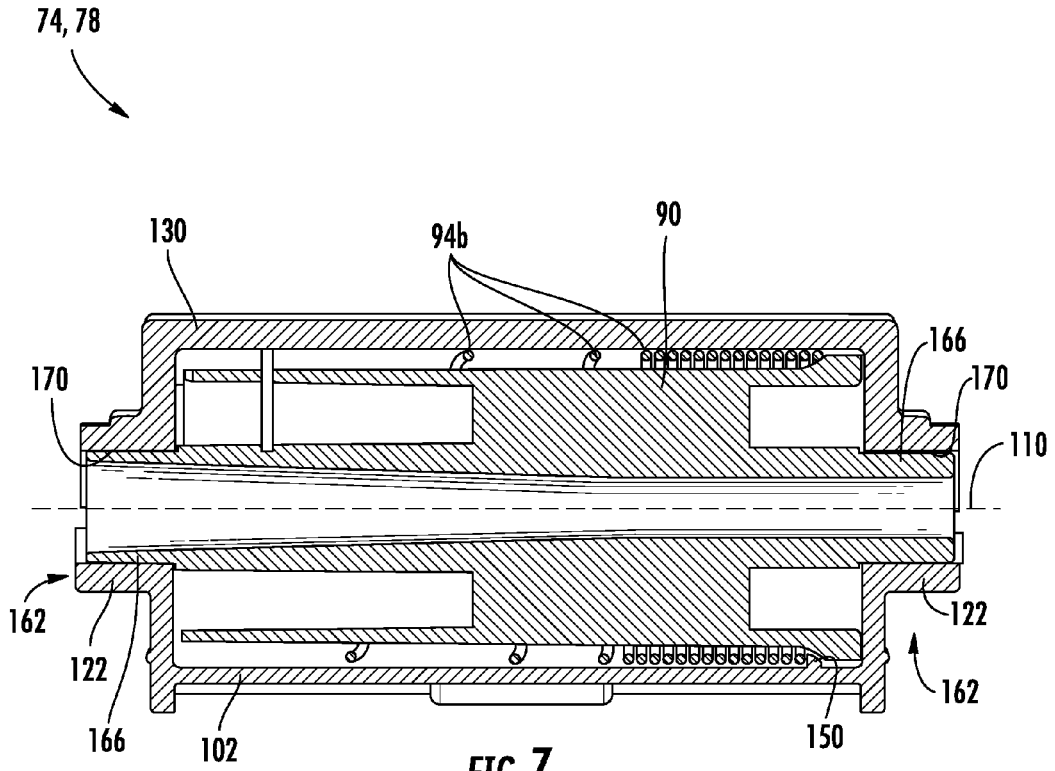
FIG. 7 is a cross-section view of the cradle assembly of FIG. 3 taken along lines 7-7 shown in FIG. 3.

With reference to FIGS. 5 and 7, the cradle 102 include a rib 150 is formed in the bottom the cradle 102 underneath each of the first and second drums 86, 90. The rib 150 is provided to aid with winding the lift cords 94 onto the drums 86, 90. More specifically, the rib 150 translates the lift cords 94, or pushes the lift cords 94, along the drums 86, 90 as each lift cord 94 wraps around the respective drum 86, 90. By directing the cords 94 laterally along the drums 86, 90, the rib 150 prevents the lift cord 94 from wrapping around itself. In other words, with reference to FIG. 7, the as the cord 94*b* travels around the drum 90, the cord 94*b* contacts the rib 150, pushing the cord 94*b* to the left as viewed from FIG. 7. In some embodiments, the rib 150 is oriented at an angle that matches the intended cord path.

With reference to FIG. 6, an aperture 154 (i.e., opening) is formed in the cradle 102 bottom. The first lift cord 94*a* and the second lift cord 94*b* both pass through the aperture 154 defined by the cradle 102. In the illustrated embodiment, the aperture 154 has a funnel cross-sectional shape. The funnel like aperture 154 for the lift cords 94*a* 94*b* can reduce a potential misalignment between the head rail 14, the cradle assembly 74, and a plurality of cord route holes positioned through the lower window covering panel 30.

With reference to FIG. 2, the covering 10 includes two cradle assemblies 74, 78 with two spring motors 58, 62 incorporated in the head rail 14 so that both the bottom rail 22 and the intermediate rail 18 can be operated independently. As such, the lift assembly 54 includes the second cradle assembly 78 that supports a second instance of the first and second winding drums 86, 90. The first cradle assembly 74 is spaced from the second cradle assembly 78 along the respective drive shafts 66, 70, and in turn the first axis 106 and the second axis 110 (see FIGS. 2 and 3). In the illustrated embodiment, the first cradle assembly 74 is identical to the second cradle assembly 78.

The lift assembly 54 and head rail 14 arrangement according to the invention include cord take-up drums 86, 90 for the lift cords 94*a*, 94*b* to the bottom rail 22 and intermediate rail 18 that are provided immediately above the lift cord paths. In other words, the lift cords 94*a*, 94*b* hang straight down from the cradle assembly 74 (FIG. 6). Since the lift cords 94 follow the same paths, the cords to a given rail are of equal length. In other words, the lengths of the lift cords 94*b* coupled to the intermediate rail 18 are equal and the lengths of the lift cords 94*a* coupled to the bottom rail 22 are equal. In addition, since the same cord path is used for both lift cords from each of the drums down through the shade, the straight cord paths having low drag or friction. With all cord paths straight, the assembly of the lift assembly 54 is also improved with the cord path direct and straight through the shade.

With reference to FIG. 3, the winding drums 86, 90 are arranged in the cradle 102 in a forward and rearward arrangement (i.e., a side-by-side arrangement). The winding drums 86, 90 are spaced only a minimal distance apart and require no more space front to back (i.e., along the third axis 114) in the head rail 14 than a conventional cordless shade. As shown in FIG. 2, the cord drums 86, 90 are linked and driven by a longitudinal drive shaft 66, 70 that passes through each winding drum 86, 90 and into the spring assist motor 58, 62. One driveshaft accommodates all winding drums associated for a given rail, the lift cord 94 travel paths are simplified, and the spring motor 58, 62 positioning is flexible.

Figure 9:
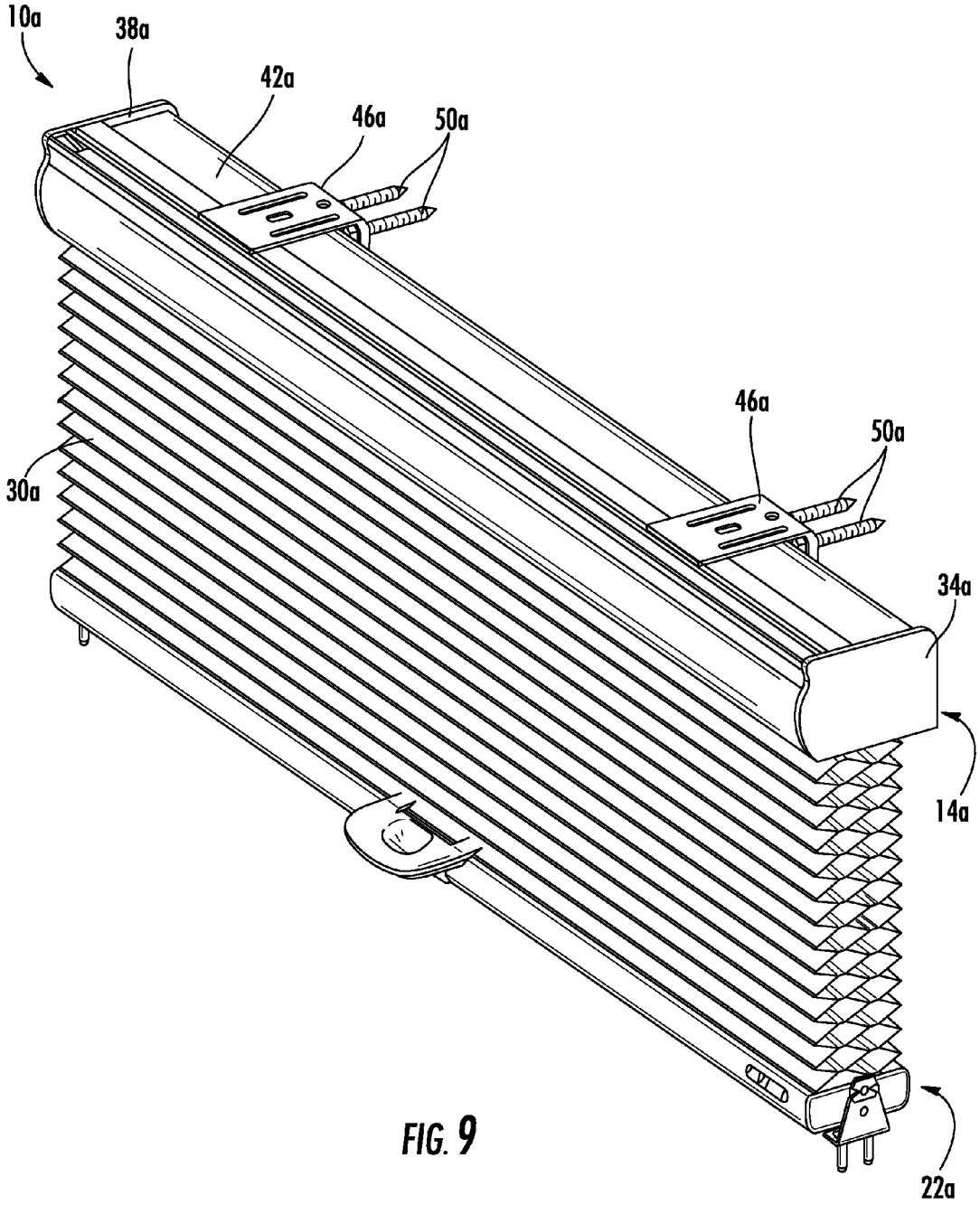
FIG. 9 is a front perspective view of a window covering in accordance with an embodiment of the invention.
Figure 10:
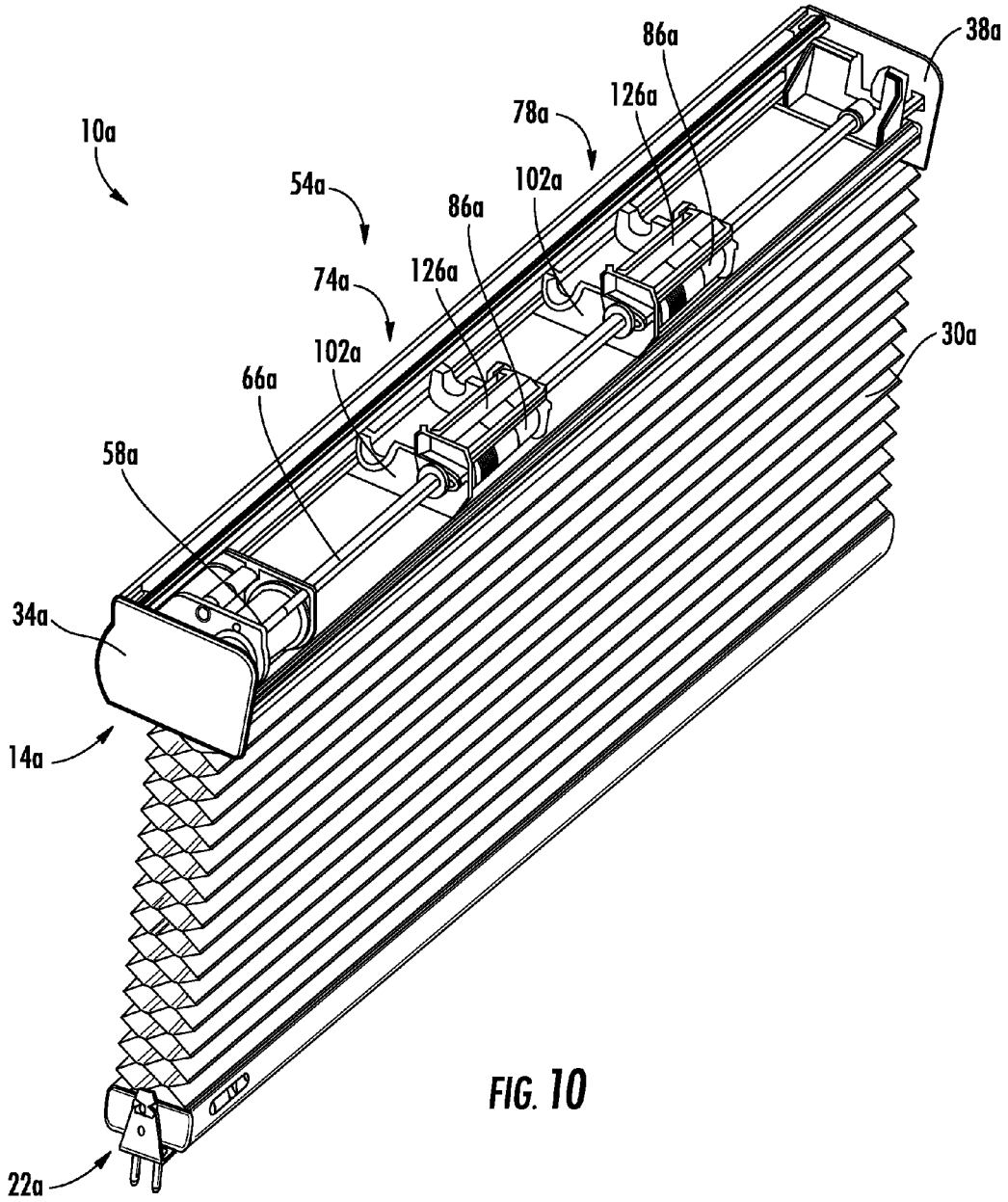
FIG. 10 is a rear perspective view of the window covering of FIG. 9 with portions removed to clearly show a lift assembly including two cradle assemblies.

Another embodiment of a covering 10*a* is shown in FIGS. 9 and 10. Like features and components are shown with like reference numerals plus the letter "a." The covering 10*a* includes a head rail 14*a*, a bottom rail 22*a*, and a window covering panel 30*a* extended therebetween. The main difference between the covering 10 of FIGS. 1 and 2 and the covering 10*a* of FIGS. 9 and 10 is the covering 10*a* only includes two total rails 14*a*, 22*a*. More specifically, the covering 10*a* also includes a first end cap 34*a*, a second end cap 38*a*, a dust cover 42*a*, brackets 46*a*, and fasteners 50 that are all similar to the covering 10.

With reference to FIG. 10, the covering 10 includes a lift assembly 54*a* includes a first spring motor 58*a*, a first drive shaft 66*a* (i.e., a drive rod), a first cradle assembly 74*a*, and a second cradle assembly 78*a*. In the illustrated embodiment, the first spring motor 58*a* is drivingly coupled to the first drive shaft 66*a*. The first cradle assembly 74*a* and the second cradle assembly 78*a* are each coupled to the first drive shaft 66*a*. The first spring motor 58*a* is provided for assisting a user with lifting the bottom rail 22*a* (including the window covering panel 30*a*) between the fully extended and fully retracted positions. The first and second cradle assemblies 74*a*, 78*a* of FIG. 10 are identical to the first and second cradle assembly 74, 78 of FIG. 2, except that the first and second cradle assemblies 74*a*, 78*a* each include a cradle 102*a* rotatably supporting only a single winding drum 86*a* and a single pivoting cover 126*a*. In other words, half of the cradle 102*a* is left empty in the cradle assemblies 74*a*, 78*a* of FIG. 10 since only a single rail (i.e., the bottom rail 22*a*) is being controlled. As such, the cradle assemblies are modular and can be used in a variety of window covering applications. By using identical cradle assemblies that can be utilized on different types of coverings, the number of stock components required to manufacture the different types of coverings is reduced.

Various features and advantages of the invention are set forth in the following claims.

What is claimed is:

1. A covering for an architectural opening comprising:
a first rail;
a second rail moveable relative to the first rail; and
a lift assembly coupled to the first rail; the lift assembly including:
a drum having a hub, the drum rotatable about an axis;
a cord coupled to the drum; and
a brake movable relative to the drum;
wherein the cord biases the brake toward the drum and into engagement with the hub to resist the second rail moving away from the first rail.

2. The covering of claim 1, wherein the lift assembly further comprises a cord that couples the drum to the second rail.

3. The covering of claim 2, wherein the brake includes a cover at least partially surrounding the hub.

4. The covering of claim 3, wherein the cover is pivotally coupled to a cradle that rotatably supports the drum.

5. The covering of claim 4, wherein the brake further includes a support extending from the cradle and positioned underneath the hub.

6. The covering of claim 5, wherein the cover pivots towards the support and engages the hub of the drum in response to the second rail moving away from the first rail.

7. The covering of claim 6, wherein the cover remains engaged with the hub of the drum when the second rail is stationary with respect to the first rail.

8. The covering of claim 7, wherein the cover pivots away from the support and disengages the hub of the drum in response to the second rail moving toward the first rail.

9. The covering of claim 8, wherein the cover includes a wear bar that engages the cord.

10. The covering of claim 1, further comprising
a third rail moveable relative to the first rail;
and wherein the lift assembly further includes
a second drum rotatably supported within the cradle about a second axis, and
a second brake selectively engageable with the second drum,
wherein the second brake automatically engages the second drum to resist the third rail moving away from the first rail; and wherein the second brake automatically disengages the second drum in response to the third rail moving toward the first rail.

11. The covering of claim 10, wherein the lift assembly further includes:
a second cord coupled between the second drum and the third rail,
wherein the second drum includes a second hub and the second brake includes a second cover at least partially surrounding the second hub.

12. A cradle assembly for an architectural opening covering, the cradle assembly comprising:
a cradle;
a drum supported within the cradle and rotatable about an axis;
a cord coupled to the drum; and
a cover pivotally coupled to the cradle;
wherein the cord biases the cover to pivot toward the drum and apply a braking force that inhibits rotation of the drum.

13. The cradle assembly of claim 12, wherein the cradle includes a support extending along the axis upon which the drum is rotatable.

14. The cradle assembly of claim 12, wherein the cover includes a wear bar and wherein the cord is supported upon the wear bar.

15. The cradle assembly of claim 14, wherein the cord biases the cover to pivot toward the drum and apply a braking force that inhibits rotation of the drum in response to the cord being unwound from the drum.

16. The cradle assembly of claim 12, wherein the cover is configured to pivot away from the cradle in order to allow the drum to be removed from the cradle.

17. The cradle assembly of claim 12, wherein the cradle includes a rib in contact with the cord to guide the cord along the drum.

18. The cradle assembly of claim 12, further including a second drum supported within the cradle and rotatable about a second axis, a second cord coupled to the second drum, and a second cover pivotally coupled to the cradle, wherein the second cord biases the second cover to pivot toward the second drum and apply a second braking force that inhibits rotation of the second drum.

19. The cradle assembly of claim 18, wherein the cradle includes an aperture through which the cord and the second cord pass.

20. A covering for an architectural opening comprising:
a head rail;
a bottom rail moveable relative to the head rail; and
a lift assembly coupled to the head rail, the lift assembly including:
a spring motor;
a drive shaft coupled to the spring motor and defining a rotational axis;
a cradle rotatably supporting a drum about the rotational axis;
a cord coupled between the drum and the bottom rail; and
a cover movably coupled to the cradle;
wherein in response to the bottom rail moving away from the head rail, the cord biases the cover to move toward the drum and increase a braking force that inhibits rotation of the drum, and wherein in response to the bottom rail moving toward the first rail the braking force is reduced.

* * * * *